United States Patent [19]

Williams

[11] 4,340,376

[45] Jul. 20, 1982

[54] SURFBOARD LOCKING DEVICE

[76] Inventor: Warren S. Williams, 1084 Evergreen Dr., Encinitas, Calif. 92024

[21] Appl. No.: 173,855

[22] Filed: Jul. 30, 1980

[51] Int. Cl.[3] ..... A63C 15/00

[52] U.S. Cl. ..... 441/74; 70/58

[58] Field of Search ..... 9/310 E, 310 A; 114/126-143; 70/58-62

[56] References Cited

U.S. PATENT DOCUMENTS

| | | | |
|---|---|---|---|
| Re. 30,523 | 2/1981 | Rich | 70/58 |
| 3,564,632 | 2/1971 | Bahne | 9/310 E |
| 3,625,031 | 12/1971 | Alley | 70/58 |

*Primary Examiner*—Trygve M. Blix

*Assistant Examiner*—Thomas J. Brahan

[57] ABSTRACT

A portable locking device for surfboards equipped with adjustable surfboard fin holders. A U shaped padlock eye attaches to the base of the surfboard fin by means of the retaining screw which retains the surfboard fin in the fin holder. A locking bracket is placed over and locked to the padlock eye with a padlock together with the ends of a flexible member which connects the surfboard to a fixed object. When locked in place, the locking bracket prevents the unauthorized removal of the padlock eye from the surfboard by preventing access to the surfboard fin retaining screw and by preventing the rotation of the padlock eye and surfboard fin retaining screw.

9 Claims, 4 Drawing Figures

SURFBOARD LOCKING DEVICE

BACKGROUND OF THE INVENTION

The instant invention relates generally to locking devices and more particularly to a surfboard locking device which may be used to lock surfboards equipped with adjustable surfboard fin holders to a fixed object.

The primary problem in locking a surfboard to a fixed object is that the shape and structure of surfboards do not provide an obvious but convenient and secure point of attachment for a locking means and a cable or chain. The various approaches which have been used in the past to lock surfboards deflect different attempts to solve or work around this problem, but none are without disadvantages.

For example, some surfers have locked surfboads with cables or chains passed through holes specially drilled through the surfboard. The disadvantage of this method is that the necessary hole disturbs the physical integrity and aesthetics of the surfboard and its performance while in use.

Other surfers have locked their surfboards with thin flexible steel cables passed under the pin of the surboard leash cup installed on many surfboards to provide a point of attachment for the surfboard leg rope or "leash" which connect the surfer to his surfboard. However, many surfboards cannot be locked in this fashion because they are not equipped with leash cups. Also, this method is inconvenient in use because the leash must usually be unattached from the leash cup pin before the cable may be passed under and around the pin. Finally, this method is subject to relatively easy tampering because leash cups are so small that the cable used must be very thin in order to pass under the leash cup pin and can thus be readily cut with handtools, and because leash cups themselves can be forceably removed from a surfboard without causing serious harm to the surfboard or its usefulness.

A third method for locking surfboards employs flexible steel cables which harness the surfboard at its front and rear ends. This method, however, is inconvenient and involves the use of a large amount of materials, in that cumbersome cables are required to be adjustably fastened near the front and rear ends of the surfboad, then to each other, and finally to a locking cable or chain. Also, in order to tightly encircle and harness the surfboard near its front and rear ends, it is necessary to use a thin cable subject to relatively easy cutting.

A fourth method previously employed by surfers involves the use of chains permanently attached to the roof of a vehicle to harness and lock a surfboard to the vehicle. The use of this method, however, is limited to the locking of surfboards to the tops of vehicles or to similar structures and requires the permanent fastening of chains thereto.

The end result of the disadvantages of the abovementioned surfboard locking methods is that very few surfers presently utilize any method whatsoever to lock their surfboards to other objects. Instead, surfers either stay with their surfboards at all times while away from home, leave them inside locked vehicles or in the care of someone else, or leave then unattended with the risk of loss or unauthorized use.

SUMMARY OF THE INVENTION

Accordingly, one object of the invention is to provide an improved surfboard lock which can be used to lock most surfboards without requiring any permanent physical alterations to be made thereto. Another object of the invention is to provide a surfboard lock which is convenient in use, simple and inexpensive to manufacture. A further object of the invention is to provide a surfboard lock which is relatively secure against tampering. Yet another object of the invention is to provide a surfboard lock which permits most surfboards to be locked to any other object through or around which a cable or chain may be passed, and not just to an object specially adapted to harness and lock a surfboard.

These and other objects and advantages are achieved according to the present invention by providing, in its preferred embodiment, a surfboard lock utilizing as the point of attachment for a locking cable or chain a special padlock eye attached to the surfboard at the base of the surfboard fin by the same screw which retains the surfboard fin in the adjustable surfboard fin holder used in the construction of most new surfboards. An auxiliary locking means, typically a padlock, is used to lock a locking bracket and a cable or chain to the padlock eye and thus to the surfboard. The locking bracket is of such structure and shape that a would-be thief cannot then access or unscrew the surfboard fin retaining screw in order to remove the padlock eye. No permanent alterations to the surfboard need to be made in order to utilize the device because the padlock eye may be easily and quickly attached to and removed from a surfboard already equipped by the manufacturer with a standard adjustable surfboard fin holder. The device is relatively secure against tampering because a thick guage flexible steel cable or chain may be used to connect the surfboard to another object and because the adjustable surfboard fin holder to which the device is anchored is firmly fiberglassed by the surfboard manufacturer into the surfboard and cannot be removed easily or without causing serious damage to the surfboard and its usefulness. Using the device, a surfer can lock his surfboard to anything around or through which the end of a cable or chain could be passed, such as surfboard racks on a car, the post of a pier or other fixed structure, a fence railing, a bicycle rack, etc., and which would form an immoveable or bulky and ackward package for a would-be thief, and not merely to another object specially adapted to lock a surfboard. Further, a surfer can use the locking cable or chain to lock other items, such as neoprene wet suits, articles of clothing, backpacks and even bicycles, at the same time as he locks his surfboard by simply passing one of the cable or chain ends through holes in these items prior to locking it to the surfboard. Finally, when a surfer is using his surfboard, he can use the padlock and cable or chain to lock the device itself to another object, along with other items as mentioned immediately above.

Further objects and advantages of the invention will become apparent from a consideration of the drawings and ensuring description thereof.

DETAILED DESCRIPTION OF THE DRAWINGS

Figure 1:
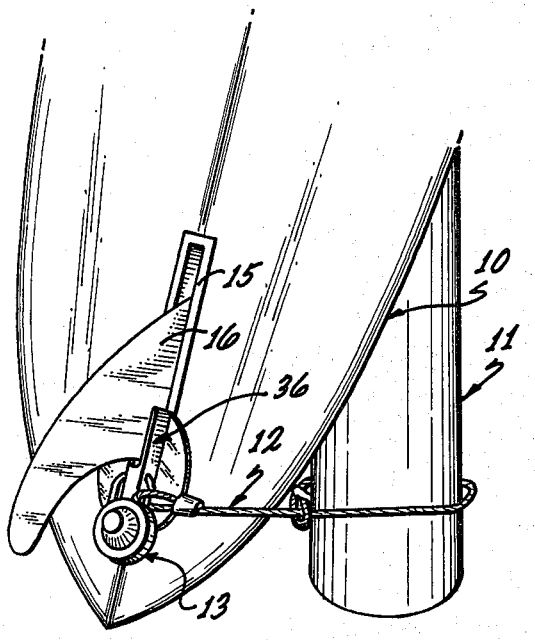
FIG. 1 is a perspective view of a typical modern surfboard locked to a fixed structure by means of the instant invention.

Referring to FIG. 1, a typical modern surfboard 10 is shown secured to a fixed structure 11 by means of the instant invention, comprising an elongated flexible member 12 (typically a flexible steel cable or chain) having a loop or hole at each end thereof, a padlock 13, a locking bracket 36, and an attachment means concealed by locking bracket 36.

Figure 2:
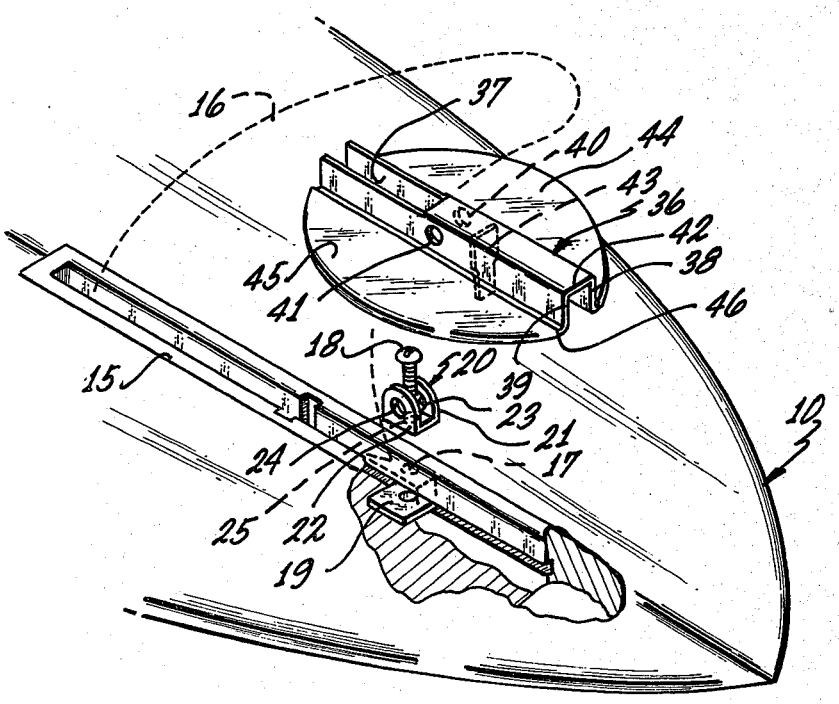
FIG. 2 is an isometric view of the underside of the rear of the surfboard shown in FIG. 1 with a partial broken-out section, and of the parts of the instant invention is exploded form.

Referring to FIG. 2, the underside of the rear of surfboard 10 is shown together with, in exploded form, the parts of the instant invention. Surfboard 10 is equipped with a surfboard fin 16 and an adjustable surfboard fin holder 15 of the type used in the construction of most new surfboards (hereinafter referred to as "fin holder 15"). Fin holder 15 is typically fiberglassed by the surfboard manufacturer into a recess in the underside of surfboard 10. In order to retain surfboard fin 16 in fin holder 15, a fin retaining screw 18 passes through a hole 17 extending vertically through the base of surfboard fin 16 and threadably engages a retaining plate 19 carried in longitudinal grooves provided in the interior sidewalls of fin holder 15. Reference is made to U.S. Pat. No. 3,564,632 for a more complete discussion of this type of fin holder.

In order to achieve the objects of the instant invention, in the preferred embodiment a padlock eye 20 is attachable to surfboard 10 at the base of surfboard fin 16 by fin retaining screw 18. When so attached, padlock eye 20 is anchored by fin retaining screw 18 to retaining plate 19 carried by fin holder 15, and thus provides a structure on surfboard 10 to which elongated flexible member 12 may be lockably attached by padlock 13. Padlock eye 20 has padlock shackle holes 23 and 24 extending through its vertical side arms 21 and 22 and a fin retaining screw hole 25 extending through its base portion. Padlock shackle holes 23 and 24 are aligned with each other along an axis generally parallel to the base portion of padlock eye 20. Padlock eye 20 may be provided with only one vertical arm and padlock shackle hole in order to decrease weight and manufacturing expense, but the greater strength and resistance to tampering afforded by the design illustrated outweighs the benefits of such alternative design. Padlock eye 20 can be inexpensively stamped from a strong, corrosion resistant metal such as stainless steel.

Figure 4:
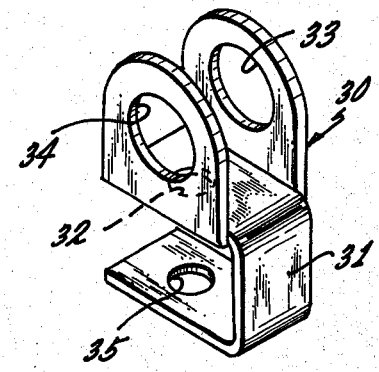
FIG. 4 is an isometric view of a modified padlock eye attachment means.
Figure 3:
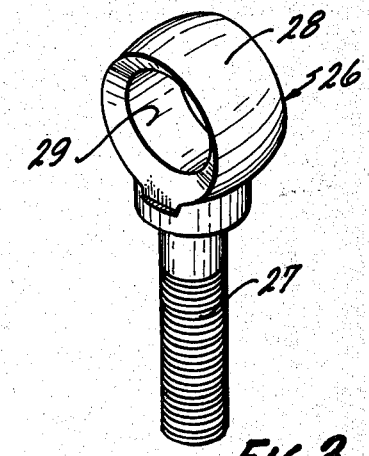
FIG. 3 is an isometric view of an eyebolt attachment means.

Referring for the moment to FIGS. 3 and 4, it can be seen that the function of padlock eye 20 can be performed by other alternative attachment means. In FIG. 3 is shown an eyebolt attachment means 26 incorporating a threaded lower portion 27 for threadably engaging retaining plate 19 and an enlarged head portion 28 having a padlock shackle hole 29 extending therethrough along an axis generally perpendicular to the longitudinal axis of threaded lower portion 27. Eyebolt attachment means 26 simply replaces fin retaining screw 18, thereby serving both to retain surfboard fin 16 in fin holder 15 and to provide a structure on surfboard 10 to which elongated flexible member 12 may be lockably attached by padlock 13. Similar eyebolt type fin retaining screws are currently used by some surfers to provide a convenient point of attachment for a surfboard leg rope or leash. However, the diameter of the hole extending through the enlarged head of such eyebolt type fin retaining screw is not large enough to permit the passage of the shackles of most padlocks if the leg rope remains attached thereto. Therefore, in order to permit a surfer to lock his surfboard without having to remove the surfboard leg rope first, eyebolt attachment means 26 may be provided with a padlock shackle hole 29 of sufficient diameter to permit the passage therethrough of the shackle of padlock 13 even though the surfboard leg rope remains attached to eyebolt attachment means 26. Although more convenient in use than padlock eye 20, eyebolt attachment means 26 would be more expensive to manufacture from a strong, corrosion resistant metal such as stainless steel.

In FIG. 4 is shown another alternative attachment means comprising a modified padlock eye attachment means 30 having an L shaped tab 31 extending from one end of the base portion thereof. When modified padlock eye attachment means 30 is attached to surfboard 10, L shaped tab 31 extends down into the elongated channel defined by the interior sidewalls of fin holder 15 and under the base of surfboard fin 16 and retaining plate 19. Like padlock eye 20, modified padlock eye attachment means 30 has padlock shackle holes 33 and 34 extending through its vertical side arms and a fin retaining screw hole 32 extending through its base portion. Padlock shackle holes 33 and 34 are also aligned with each other along an axis generally parallel to the base portion of modified padlock eye attachment means 30. L shaped tab 31, however, has a second fin retaining screw hole 35 extending through the base portion of L shaped tab 31 in such location that, when modified padlock eye attachment means 30 is attached at the base of surfboard fin 16 with fin retaining screw 18, fin retaining screw 18 passes through second fin retaining screw hole 35 after threadably engaging retaining plate 19. Second fin retaining screw hole 35 may also be threaded for interengaging fin retaining screw 18, if desired. Modified padlock eye attachment means 30 may also be provided with a means for attaching a surfboard leg rope by simply extending a hole through or attaching an eyebolt, ring or similar structure to the vertical arm of L shaped tab 31. Modified padlock eye attachment means 30 provides a stronger point of attachment on surfboard 10 than the other attachment means discussed, but it is not as easy or convenient to attach to surfboard 10 as the others and is more expensive to manufacture than padlock eye 20.

Referring again to FIG. 2, a locking bracket 36 is shown, having a surfboard fin slot 37 defined longitudinally along one portion thereof by spaced apart side walls 38 and 39. Locking bracket 36 also has padlock shackle holes 40 and 41 extending through side walls 38 and 39 at locations under top portion 42 of locking bracket 36. Padlock shackle holes 40 and 41 are aligned with each other along an axis generally parallel to top portion 42. Like padlock eye 20, locking bracket 36 can be inexpensively stamped from a strong, corrosion resistant metal such as stainless steel.

The function of locking bracket 36 is to prevent the unauthorized removal of padlock eye 20 (or an alternative attachment means) from surfboard 10 when locking bracket 36 is lockably attached thereto by padlock 13. First, access to fin retaining screw 18 which anchors padlock eye 20 (or modified padlock eye attachment means 30) to surfboard 10 is prevented by side walls 38 and 39 and top portion 42. Second, rotation of locking bracket 36 and padlock eye 20 (or eyebolt attachment means 26) relative to surfboard 10 is blocked by surfboard fin 16 where it extends within surfboard fin slot 37. Such rotational movement might otherwise be used by a would-be thief to unscrew and removed eyebolt attachment means 26 or padlock eye 20. The said blocking action of surfboard fin 16 is sufficient to prevent such rotational movement. However, a tab 43 may also be attached to locking bracket 36 to provide added security. When locking bracket 36 is locked to padlock eye 20 or to one of the alternative attachment means, tab 43 extends down into the elongated channel defined by the interior sidewalls of fin holder 15, thereby further inhibiting the application of rotational force intended by a would-be thief to break or shear padlock eye 20 (or one of the alternative attachment means) or fin retaining screw 18. Tab 43, typically welded to the underside of top portion 42, may also be attached to side walls 38 and 39 to provide additional strength to locking bracket 36.

Although not essential to the successful operation of locking bracket 36, side plates 44 and 45 are useful to provide added strength to side walls 38 and 39 and to protect the fiberglass surface of the underside of surfboard 10 against marring and denting which could otherwise be caused by padlock 13 and the ends of elongated flexible member 12 during the locking and unlocking process. Typically, also, side plates 44 and 45 are covered with a resilient plastic material 46 to protect the fiberglass surface of the underside of surfboard 10 against scratching.

Padlock shackle holes 40 and 41 of locking bracket 36 and padlock shackle holes 23 and 24 of padlock eye 20 (and the padlock shackle holes of the alternative attachment means discussed) typically have a diameter substantially larger than that of the shackle of padlock 13 so that the U shaped portion of the shackle of padlock 13 can freely pass through the said padlock shackle holes. Otherwise, the device is less secure against tampering inasmuch as a would-be thief could use the shackle of padlock 13 to apply considerable force and leverage against padlock eye 20 (or one of the alternative attachment means), fin retaining screw 18, the base of surfboard fin 16, retaining plate 19, and fin holder 15 in an effort to break padlock eye 20 (or one of the alternative attachment means) or fin holder 15 free from surfboard 10.

Padlock shackle holes 40 and 41 of locking bracket 36 are typically positioned so that the distance between their centers and the bottom surfaces of side walls 38 and 39 is equal to the distance between the center of padlock shackle holes 23 and 24 and the bottom surface of padlock eye 20. Said postioning assures that padlock shackle holes 40 and 41 of locking bracket 36 are vertically alignable with padlock shackle holes 23 and 24 of padlock eye 20 when padlock eye 20 is in the closest expectable vertical position relative to the underside of surfboard 10. For conventional surfboards utilizing standard fin holders and surfboard fins, the closest expectable vertical position of padlock eye 20 relative to the underside of surfboard 10 is one in which the bottom surface of padlock eye 20 will be flush with the underside of surfboard 10. The actual distance between the bottom surface of padlock eye 20 and the underside of surfboard 10 will usually be greater than zero, however, because fin holders are generally not recessed to the greatest possible depth into the underside of a surfboard.

In order to lock surfboard 10 to fixed object 11 with the instant invention as illustrated in FIG. 1, it is necessary first to attach one of the attachment means to surfboard 10 at the base of surfboard fin 16. Padlock eye 20 and modified padlock eye attachment means 30 are attached with fin retaining screw 18, and eyebolt attachment means 26 is attached by inserting threaded lower portion 27 into hole 17 of surfboard fin 16 until it reaches retaining plate 19, at which point it may be screwed into retaining plate 19. Whichever attachment means employed is installed in such manner that the axis of its padlock shackle hole or holes is roughly perpendicular to the longitudinal centerline of surfboard 10. Then, locking bracket 36 is placed over the attachment means and the underside of surfboard 10 in such a position that: (1) padlock shackle holes 40 and 41 of locking bracket 36 are aligned with the padlock shackle hole or holes of the attachment means, (2) surfboard fin 16 extends within surfboard fin slot 37, and (3) tab 43 extends into the elongated channel defined by the interior sidewalls of fin holder 15. Next, the shackle of unlocked padlock 13 is passed through the aligned padlock shackle holes of locking bracket 36 and the attachment means. Next, one end of elongated flexible member 12 is passed around fixed structure 11, through the loop or hole in the other end of elongated flexible member 12, and back to the rear of surfboard 10 where it is attached to locking bracket 36 and the attachment means by the shackle of unlocked padlock 13. Finally, padlock 13 is locked and surfboard 10 is thereby secured to fixed structure 11, as shown in FIG. 1. (Alternatively, of course, both ends of elongated flexible member 12 may be attached by padlock 13 to locking bracket 36 and the attachment means should it be impossible to pass one end of elongated flexible member 12 through the loop or hole in the other end of elongated flexible member 12).

To unlock surfboard 10, padlock 13 is first unlocked and its shackle withdrawn from the end or ends of elongated flexible member 12 and from the padlock shackle holes of locking bracket 36 and the attachment means. Then, locking bracket 36 may be removed. It is not necessary or particularly advantageous to remove the attachment means from surfboard 10 because the attachment means is typically made of a corrosion resistant metal which will resist harm caused by periodic exposure to salt water and also because it is not of sufficient size or weight to cause a significant adverse difference in the handling characteristics of surfboard 10.

The subject extensive disclosure will suggest or render apparent to those skilled in the art various modifications and variations within the spirit and scope of the subject invention. For example, the function of locking bracket 36 to prevent removal of the attachment means when locked thereto could be performed by a variety of structures. First, locking bracket 36 need not be provided with surfboard fin slot 37 as long as tab 43 is provided to the rear of padlock shackle holes 40 and 41, or as long as locking bracket 36 extends far enough to the rear of padlock shackle holes 40 and 41 to abut against surfboard fin 16 is rotated relative to surfboard 10 when locked to the attachment means.

As a second example, a very simple means to perform the same function as locking bracket 36 when the attachment means is secured to surfboard 10 with fin retaining screw 18 comprises a Y shaped member having a front portion defining a surfboard fin slot and a rear portion which is more narrow than the front portion and which is dimensioned so that it can be positioned in between the vertical arms of the attachment means. Operation consists of of placing the Y shaped member on surfboard 10 so that surfboard fin 16 exends into the surfboard fin slot and the rear portion extends immediately above and to the rear of fin retaining screw 18. When padlock 13 is locked to the attachment means, the Y shaped member cannot be removed from its position blocking rotation of the attachment means and preventing access to fin retaining screw 18, thus providing a lockable means to provide the removal of the attachment means.

An another example, an H shaped member defining a surfboard fin slot in the front portion thereof and an eyebolt attachment means slot in the rear can ber provided as a lockable means to prevent the unauthorized removal of eyebolt attachment means 26. In this variation the upper portion of eyebolt attachment means 26 is provided with generally parallel flat sides immediately below its padlock shackle hole 29, and the width of the eyebolt attachment means slot is equal to or slightly greater than the distance between the two flat sides of eyebolt attachment means 26. When the H shaped member is placed on surfboard 10 so that surfboard fin 16 extends into its surfboad fin slot and eyebolt attachment means 26 extends into its eyebolt attachment means slot, the H shaped member blocks the rotation of eyebolt attachment means 26 relative to surfboard 10 preventing its removal. When padlock 13 is locked to eyebolt attachment means 26, the H shaped member cannot be removed from such position.

As further variations, the H shaped member and Y shaped member may be provided with side plates 44 and 45 and/or with a tab for extending into the elongated channel defined by the interior sidewalls of fin holder 15.

Also, in order that locking bracket 36 may further inhibit access to fin retaining screw 18, a second tab may be provided extending generally vertically from top portion 42 to the bottoms of side walls 38 and 39 in a location immediately to the rear of surfboard fin slot 37.

Thus it can be seen that the function of locking bracket 36 can be performed by any structure which is lockable to surfboard 10 in such a position that it will prevent access to fin retaining screw 18, if the attachment means is secured to surfboard 10 by fin retaining screw 18, and will cooperate with the structure of surfboard 10 to prevent the rotation of the attachment means relative to surfboard 10. Accordingly, the scope of the invention should be determined not by the embodiments illustrated, but by the appended claims and their legal equivalents.

I claim:

1. A locking device for surfboards equipped with fin holders wherein a fin retaining screw attaches the surfboard fin to a threaded retaining plate carried by the fin holder, comprising in combination:

a padlock;

an elongated flexible member having a loop or hole at each end thereof;

attachment means for attaching to the surfboard at the base of the surfboard fin engaging the threaded retaining plate carried by the fin holder to provide a point of attachment for lockably connecting the surfboard to another object with the padlock and elongated flexible member; and means for lockably attaching to the attachment means with the padlock and cooperating with the structure of the surfboard to prevent the unauthorized removal of the attachment means from the surfboard.

2. A locking device for surfboards equipped with fin holders wherein a fin retaining screw attaches the surfboard fin to a threaded retaining plate carried by the fin holder, comprising in combination:

padlock;

an elongated flexible member having a loop or hole at each end thereof;

a U shaped padlock eye having a fin retaining screw hole extending through the base portion thereof and padlock shackle holes extending through the vertical side arms thereof, which padlock shackle holes are aligned with each other along an axis generally parallel to the said base portion, whereby said U shaped padlock eye is attachable to the surfboard at the base of the surfboard fin with the fin retaining screw to provide a point of attachment for lockably connecting the surfboard to another object with the padlock and elongated flexible member; and a locking bracket having a top portion and spaced apart side walls, said side walls defining a surfboard fin slot longitudinally along one portion of the locking bracket and further having padlock shackle holes extending through the side walls and under the top portion which are aligned with each other along an axis generally parallel to the top portion and which are alignable with the padlock shackle holes of the U shaped padlock eye, said locking bracket further including side plates extending laterally to each side of the locking bracket from the bottoms of the said side walls and further having a tab attached to the locking bracket which extends below the underside surface of the side plates, whereby the locking bracket is lockably attachable to the U shaped padlock eye with the padlock to prevent the unauthorized removal of the U shaped padlock eye from the surfboard and to protect the underside surface of the surfboard against damage which could be caused by the padlock and the ends of the elongated flexible member.

3. A surfboard locking device as claimed in claim 2, wherein:

the side plates of the locking bracket are covered with a resilient plastic material.

4. A locking device for surfboards equipped with fin holders wherein a fin retaining screw attaches the surfboard fin to a threaded retaining plate carried by the fin holder, comprising in combination:

a padlock;

an elongated flexible member having a loop or hole at each end thereof;

a U shaped padlock eye having a fin retaining screw hole extending through the base portion thereof and padlock shackle holes extending through the vertical side arms thereof, which padlock shackle holes are aligned with each other along an axis generally parallel to the said base portion, whereby said U shaped padlock eye is attachable to the surfboard at the base of the surfboard fin with the fin retaining screw to provide a point of attachment for lockably connecting the surfboard to another object with the padlock and elongated flexible member; and means for lockably attaching to the U shaped padlock eye with the padlock to prevent unauthorized access to the fin retaining screw and for cooperating with the structure of the surfboard to obstruct the unauthorized rotation of the padlock eye relative to the surfboard.

5. A locking device for surfboards equipped with fin holders wherein a fin retaining screw attaches the surfboard fin to a threaded retaining plate carried by the fin holder, comprising in combination:

a padlock;

an elongated flexible member having a loop or hole at each end thereof;

an eyebolt having a threaded lower portion for interengaging the threaded retaining plate carried by the fin holder and further including an upper portion having a padlock shackle hole extending therethrough along an axis generally perpendicular to the longitudinal axis of the said lower portion, whereby said eyebolt is attachable to the surfboard at the base of the surfboard fin to provide a point of attachment for lockably attaching the surfboard to another object with the padlock and elongated flexible member; and means for lockably attaching to the eyebolt and cooperating with the structure of the surfboard to prevent the unauthorized rotation of the eyebolt relative to the surfboard.

6. A locking device for surfboards equipped with fin holders wherein a fin retaining screw attaches the surfboard fin to a threaded retaining plate carried by the fin holder, comprising in combination:

a padlock;

an elongated flexible member having a loop or hole at each end thereof;

attachment means for attaching to the surfboard at the base of the surfboard fin to provide a point of attachment for lockably connecting the surfboard to another object with the padlock and elongated flexible member; and a locking bracket having a top portion and spaced apart side walls, said side walls defining a surfboard fin slot longitudinally along one portion of the locking bracket and further having padlock shackle holes extending through the side walls and under the top portion which are aligned with each other along an axis generally parallel to the top portion and which are alignable with the padlock shackle hole or holes of the attachment means, whereby the locking bracket may be lockably attached to the attachment means with the padlock to prevent the unauthorized removal of the attachment means from the surfboard.

7. A surfboard locking device as claimed in claim 6 wherein:

the locking bracket includes a tab attached thereto and extending below the bottoms of the side walls thereof for extending into the elongated channel defined by the interior side walls of the fin holder.

8. A surfboard locking device as claimed in claim 6 wherein:

the locking bracket includes side plates extending laterally to each side thereof from the bottoms of the side walls of the locking bracket.

9. A surfboard locking device as claimed in claim 8 wherein:

the locking bracket further includes a tab attached to the locking bracket and extending below the bottom surfaces of the side plates for extending into the elongated channel defined by the interior side walls of the fin holder.

* * * * *